US005411719A

United States Patent [19]

Hollitt et al.

[11] Patent Number: 5,411,719

[45] Date of Patent: May 2, 1995

[54] PRODUCTION OF ACID SOLUBLE TITANIA

[75] Inventors: Michael J. Hollitt, S. Melbourne; Brian A. O'Brien, Bentley, both of Australia

[73] Assignee: Wimmera Industrial Minerals Pty. Ltd., South Melbourne, Australia

[21] Appl. No.: 127,296

[22] Filed: Sep. 24, 1993

Related U.S. Application Data

[63] Continuation of Ser. No. 776,242, Dec. 27, 1991, abandoned.

[30] Foreign Application Priority Data

May 11, 1989 [AU] Australia ..... PJ4122

[51] Int. Cl.[6] ..... C22B 1/02; C01G 23/047; C01G 23/08

[52] U.S. Cl. ..... 423/69; 423/80; 423/83; 423/85

[58] Field of Search ..... 423/69, 80, 83, 85, 423/138, 151, 8, 610, 611

[56] References Cited

U.S. PATENT DOCUMENTS

| | | | |
|---|---|---|---|
| 2,954,278 | 9/1960 | Gaskin | 423/80 |
| 3,502,460 | 3/1970 | Martin et al. | 423/80 |
| 4,923,682 | 5/1990 | Roberts et al. | 423/611 |

FOREIGN PATENT DOCUMENTS

| | | |
|---|---|---|
| 153986 | 11/1953 | Australia . |
| 247110 | 9/1964 | Australia . |
| 3625010 | 4/1988 | Germany . |
| 547898 | 9/1942 | United Kingdom . |
| 754453 | 8/1956 | United Kingdom . |
| 805438 | 12/1958 | United Kingdom . |
| 881808 | 11/1961 | United Kingdom . |

OTHER PUBLICATIONS

*The Development Of A Direct Reduction And Leach Process For Ilmenite Upgrading,* B. F. Bracanin, P. W. Cassidy, J. M. MacKay, H. W. Hockin; published by AIME, Paper No. A72-31, pp. 209-259, 1972. This paper was presented in the Proceedings 101st AIME, San Francisco (1972) no month avail.

*Reduction of Ilmenite In A Commercial Rotary Kiln—An X-Ray Diffraction Study,* I. E. Grey and A. F. Reid, Australian I.M.M. Conference, pp. 1-22, (May 1973).

*Primary Examiner*—David Brunsman

*Attorney, Agent, or Firm*—Price, Heneveld, Cooper, DeWitt & Litton

[57] ABSTRACT

Accordingly the present invention provides a process for producing acid soluble titania which process comprises the steps of:

(i) adding a manganese or magnesium compound to a titaniferous mineral if the mineral does not contain sufficient manganese and magnesium to satisfy the following relationship:

$$\frac{1.98\,a + 1.14\,b}{d} \geqq 0.08$$

where a represents the percentage by weight of MgO contained in the mineral, b represents the percentage by weight of MnO contained in the mineral, and d represents the percentage by weight of $TiO_2$ contained in the mineral;

(ii) heating the titaniferous mineral in the presence of a reductant at a temperature and for a time sufficient to permit contained iron to be reduced to its metallic form and contained titania to convert to an acid soluble form without significant accretion of the mineral occurring;

(iii) cooling the product of step (ii); and (iv) subjecting the product of step (iii) to an aqueous chemical treatment to substantially remove iron from the mineral wherein the manganese or magnesium compound is an oxide or is capable of decomposing to an oxide under reaction conditions.

29 Claims, 1 Drawing Sheet

FLOWSHEET OF PROCESS FOR PRODUCING ACID SOLUBLE TITANIA

FLOWSHEET OF PROCESS FOR PRODUCING ACID SOLUBLE TITANIA

PRODUCTION OF ACID SOLUBLE TITANIA

This is a continuation of application Ser. No. 07/776,242, filed Dec. 27, 1991, now abandoned.

BACKGROUND TO THE INVENTION

The present invention relates to a process for the formation of acid digestible titania products. The major application of titania bearing minerals is feed to processes for the formation of white titania pigments. Two types of alternative pigment production operations exist, viz. chloride and sulphate processing. Of particular interest to the present invention is the sulphate method of pigment production, for which specifications on mineral feed, both in composition and particle size distribution, are generally less stringent than for the chloride method.

Figure 1:
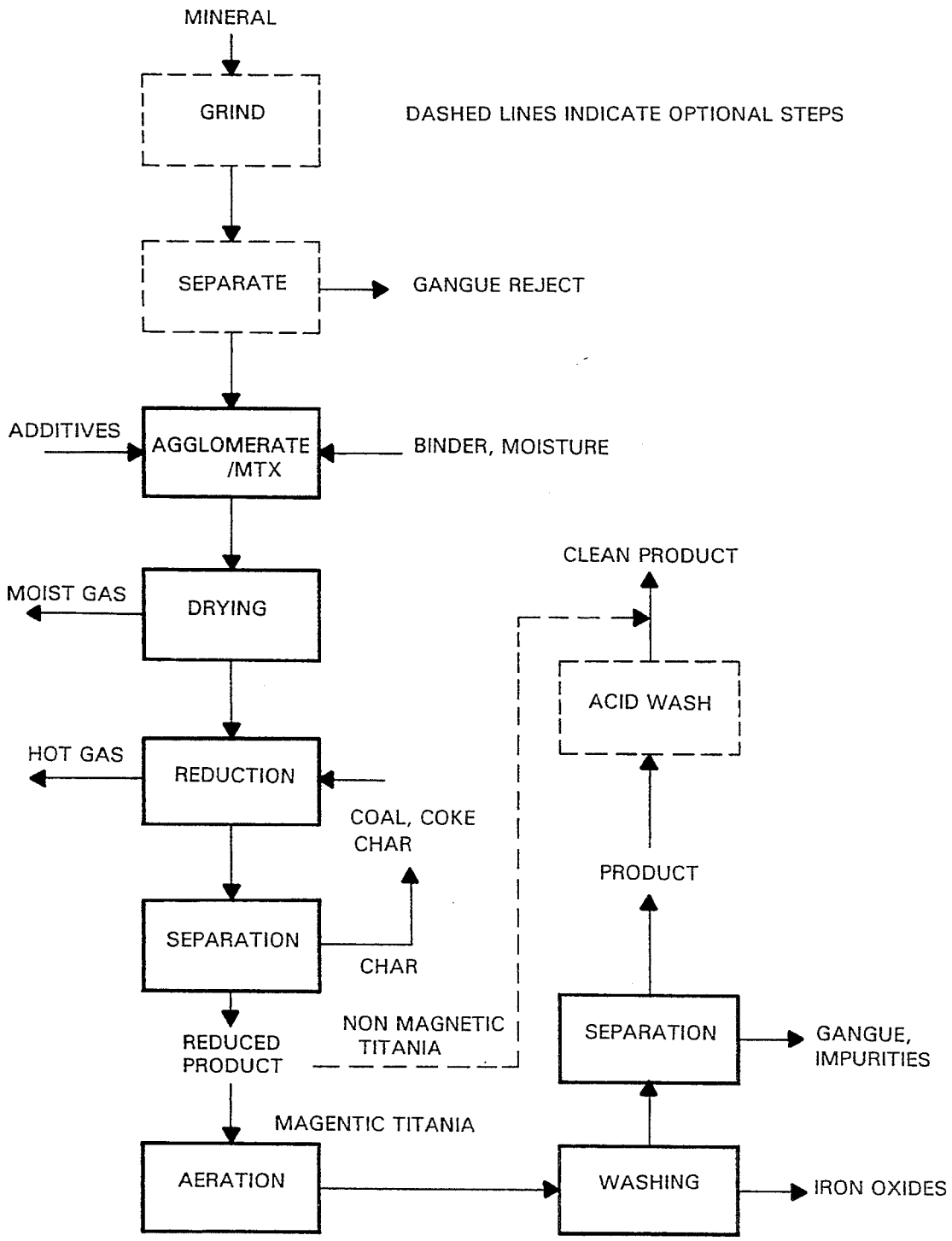
FIG. 1 is a flow sheet illustrating a preferred embodiment of the present invention.

A particular requirement of the sulphate process for pigment production is that the mineral feed should be substantially digestible in strong sulphuric acid. For naturally occurring titanium bearing minerals this requirement is met only by ilmenite mineral (FeO. $TiO_2$) or its weathered products with strictly limited degrees of alteration to rutile and ferric titanate. However, synthetic sources of acid digestible titania are available in the form of slag products formed in the smelting of ilmenite. Slag products (75–85% $TiO_2$) are considerably upgraded in comparison with acid digestible ilmenite (up to 58% $TiO_2$) and are preferred where acid consumption or waste disposal are problems for sulphate pigment producers.

In sulphate pigment production, ilmenite feed has the disadvantage of low titania content while slag feed has the coupled disadvantages of requiring dangerous and unpredictable digestion conditions and providing incomplete titania recovery in digestion and subsequent dissolution.

Not all acid digestible ilmenites are suitable for pigment production via the sulphate process or upgrading to slag. In particular, ilmenites with greater than about 0.15% $Cr_2O_3$ have not found direct or indirect application in sulphate pigment production, as chromium causes severe problems with pigment product colouration. Ilmenites with relatively high iron contents (especially in excess of the composition "FeO. $TiO_2$") and with high gangue contents (e.g. about 5% total contained alumina and silica) are unlikely to be suited for upgrading to a valuable slag product, and may also not compete economically with other feeds for the production of sulphate process pigments.

In recent years there has been a recognition that the feeding of ilmenite to sulphate pigment plants is potentially environmentally damaging since it has resulted in the discharge of relatively large quantities of acid and iron sulphate by-products either to water courses or to the ocean. There is a trend to conversion of sulphate pigment plants to accept feeds such as slag which consume less acid and produce smaller quantities of by-products. Alternatively, acid regeneration schemes which are expensive in terms of equipment and energy costs have been used to limit discharges. These costs are much reduced for operations accepting slag rather than ilmenite.

The advantages of slag over ilmenite as a feed to the sulphate process may be summarised as follows:

(i) Acid consumption is lower.

(ii) By-product wastes are reduced in quantity.

(iii) Acid regeneration requirements are reduced.

(iv) Transportation and handling costs are lower.

However, the relative prices of slag and ilmenite and limitations in slag availability have ensured that ilmenite remains an attractive feed to sulphate pigment operations.

A major consideration in the relative prices and availability of ilmenite and slag is the scale of operation required to justify capital expenditure on ilmenite smelting to slag. Most ilmenite producers are not large enough to justify such expenditure and are not located advantageously with respect to existing smelters, which are also tied to specific mineral production sites.

At present there is limited opportunity for an ilmenite producer to supply more attractive upgraded products such as slag to sulphate pigment operations. Further, it is not possible to treat alternative titanium mineral sources (e.g. leucoxene or futile) economically for the production of acid digestible titania products.

It is the object of the present invention to provide a means for the production of an acid digestible titania product for which the following are requirements:

(i) The product should be formed economically at scales of operation of less than 25% of current slagmaking operations.

(ii) The titanium content of the product should be equal to or higher than the range of titanium contents associated with slag products.

(iii) The titanium mineral source for the product may be minerals other than ilmenite. Ilmenites which are not suitable for slagmaking or direct feeding to sulphate pigment operations should also be capable of upgrading to useful products by the process considered.

(iv) Acid digestibility and titanium recovery in sulphate process pigment should be higher for the product than for currently available slag products.

(v) The process should be operable under physical conditions which can be economically attained and continuously sustained.

PRIOR ART

A process for the production of a high grade acid soluble titania product from natural minerals without the need to smelt to a slag product was previously described by Martin and Hockin (U.S. Pat. No. 3,502,460, 24 Mar. 1970). In this prior art process the titanium bearing minerals were treated with addition of magnesium compounds in a high temperature firing operation before reduction in a rotary kiln at temperatures in the range 1200°–1300° C. It was recognised that the resulting titania matrix, in which metallic iron was contained as encapsulated subgrains, was highly digestible in sulphuric acid. However, no means was indicated for the removal of the metallic iron which would be effective, economic and would avoid the production of an environmentally difficult iron waste.

An effective method for metallic iron removal by aqueous aeration in the presence of additives was described in Aust. Pat. 247110, January 1961—Becher). However, in this case, metal removal was from a matrix consisting of titania having a structure which is not acid soluble, and from which iron metal may in practice be more readily removed than for an acid soluble matrix.

A logical progression from prior art disclosure would be to combine the firing and reduction conditions necessary for the formation of an acid soluble titania matrix disclosed by Martin and Hockin with the iron removal process disclosed by Becher. In this manner an economic acid digestible titania product could be formed in a similar fashion to that used to form synthetic rutile from Western Australian ilmenite. Despite a considerable incentive for the development of such a process there has been no such successful formation of an acid soluble titania product under industrially realistic conditions.

It is considerably more difficult in practice to economically produce acid soluble titania from natural minerals than suggested in the prior art literature considered above. The reasons for the difficulties may be listed as follows:

(i) The necessary additives (specifically magnesium sources) are not readily incorporated into a titania matrix in either oxidation or reduction roasting. High temperature reduction (typically 1200°–1300° C.) is necessary with most available natural minerals for homogeneous distribution of additives to occur in static carbon beds in residence times of less than two hours, This is despite the claim in the prior art that reduction can be operated at temperatures as low as 1130° C. with sufficiently effective additive incorporation to ensure full development of acid solubility, (ii) The formation of an acid soluble titania matrix involves partial reduction of $TiO_2$ to $Ti_3O_5$. Formation of product having the required homogeneous degree of reduction from most available natural titaniferous minerals also requires relatively long residence times at high temperatures, (iii) Despite claims to the contrary in the prior art the high temperatures and residence times actually required for homogeneity of distribution of oxygen and additives within an acid soluble titania matrix result in unacceptable accretion formation in any realistic apparatus for continuously treating most natural minerals. This observation applies irrespective of whether or not pre-oxidative roasting is practised.

(iv) Under the necessary conditions for effective reduction quantities of titanium and iron nitrides and carbides are formed. These phases result in a lowering of the effectiveness of iron removal and significant reduction in titanium solubility.

(v) It has been found that removal of iron metal in an aqueous aeration process according to the methods described in the prior art (for synthetic rutile production) cannot always be applied effectively for iron removal from a matrix consisting of acid soluble titania.

(vi) For many titaniferous minerals, the presence of liberated or unliberated gangue or grains of impurities (e.g. phosphates, chromite) which cannot be easily removed from the feed mineral results in product grades which do not represent an acceptable feed to sulphate pigment production.

The need to conduct oxidative roasting of minerals according to prior art disclosure is a considerable penalty in actual processing to acid soluble titania since it involves the use of an additional high temperature treatment step. A further penalty is the stated requirement for the addition of magnesite, which is an added cost and has a substantial effect on final product grade.

It is the object of the present invention to provide an industrially useful process for the production of acid soluble titania.

Accordingly the present invention provides a process for producing acid soluble titania which process comprises the steps of:

(i) adding a manganese or magnesium compound to a titaniferous mineral if the mineral does not contain sufficient manganese and magnesium to satisfy the following relationship:

$$\frac{1.98\,a + 1.14\,b}{d} \geqq 0.08$$

where a represents the percentage by weight of MgO contained in the mineral, b represents the percentage by weight of MnO contained in the mineral, and d represents the percentage by weight of $TiO_2$ contained in the mineral;

(ii) heating the titaniferous mineral in the presence of a reductant at a temperature and for a time sufficient to permit contained iron to be reduced to its metallic form and contained titania to convert to an acid soluble form without significant accretion of the mineral occurring;

(iii) cooling the product of step (ii); and (iv) subjecting the product of step (iii) to an aqueous chemical treatment to substantially remove iron from the mineral wherein the manganese or magnesium compound is an oxide or is capable of decomposing to an oxide under reaction conditions.

In a preferred form of the invention:

(i) Titanium bearing minerals (such as ilmenite, leucoxene, anatase and rutile) are optionally mixed with small quantities of additives to provide uniform dissemination of inputs. Fine titanium minerals (e.g. those for which 100% passes through a 100 μm aperture screen) may generally be mixed without grinding. The majority of titanium bearing minerals (e.g. those found in beach sands) will benefit by grinding during mixing in order to provide adequate mineral/additive contact or sufficient mineral surface area for subsequent steps.

(ii) The minerals are then optionally agglomerated using techniques described in International Patent Application No. PCT/AU89/00314 to provide an agglomerated product which is suitable for subsequent treatment without excessive dusting.

(iii) The as received, ground or agglomerated mineral is reduced by heating to a sufficient temperature and for a sufficient time in the presence of carbon or other suitable reductant such that contained iron is substantially converted to solid metal and contained titania is converted to an acid soluble form.

(iv) Reduced mineral is cooled to near room temperature and then subjected to aqueous chemical treatment, e.g. leaching or aeration, for substantial removal of contained metallic iron. Agglomerates may be crushed prior to aqueous treatment in order to sufficiently liberate unmetallised gangue grains for separation, e.g. by magnetic separation. The resulting acid soluble upgraded titania product is washed and dried.

(v) Typically the removal of metallic iron results in disintegration of the agglomerates, liberating original gangue impurities. These impurities may be removed by a variety of means which were not previously effective or convenient.

The titania product may contain greater than 90% $TiO_2$(on the basis of contained titanium), yet it will normally have higher solubility in sulphuric acid and exhibit higher recoveries of titania in sulphate process pigment than slag products, which typically only contain up to 85% $TiO_2$. The product properties will depend on the particular feed used.

The improvements over the prior art disclosure associated with the present invention, which have allowed the formation of high value acid soluble products from natural titaniferous minerals under industrially achievable conditions, may be listed as follows:

(i) There is no need according to the present invention to operate an oxidising roast for incorporation of additives or to assist in the prevention of accretion formation.

(ii) According to the present disclosure there is never the need to operate a reduction step at temperatures in excess of 1200° C. Accretion and carbide and nitride formation, may consequently be avoided.

(iii) It is not necessary in the present disclosure to include additives for all feeds. The improvements associated with the present invention allow the maximum advantage to be taken from the composition of the as received mineral. Alternative additives to magnesium compounds have been identified as part of the present invention.

(i) Conditions have been identified which allow effectively complete removal of available metallic iron from reduced mineral products by aqueous aeration treatment without the formation of iron oxide within titanium bearing grains. Further, the type of separate iron oxide product formed (e.g. magnetite or hydrated ferric oxide) can be regulated to enhance minerals/iron oxide separations and to provide an iron oxide by-product of consistent properties.

(v) A ready separation of much of the original gangue and contaminant mineralisation can be achieved after reduction and also after metallic iron removal. This represents a particular advantage where such separations are not readily achieved with as received mineral.

The flowsheet illustrating a preferred embodiment of the invention is depicted diagrammatically in FIG. 1. The flowsheet consists of an (optional) grinding step followed by an optional mixing/agglomeration step, a thermal reduction and cooling step and an iron metal removal step. Optional mineral separations step may follow iron removal.

Where fine grained minerals are to be treated or where additives are required a particular preferred step is agglomeration prior to the heating step. For effective homogeneous incorporation of additives and homogeneous reduction of titania without the need for excessive residence times and high temperatures in reduction or the operation of a preliminary oxidative roasting step, it is important that there is a high mineral surface area and good mineral/additive mixing and contact. This is because reduction and diffusion of additives into the titania matrix occurs topotactically, from grain exteriors to grain interiors. Consequently a finer mineral particle size optionally obtained by grinding will result in higher reduction and homogenisation rates.

It has not been possible in practice to obtain the expected benefits from fine mineral particle size in reduction of titaniferous minerals because of the difficulties of containment of fine minerals in reduction systems, for which relative gas/mineral velocities are such that excessive dusting losses of mineral occur. This is especially the case where relatively long residence times (e.g. in excess of 30 minutes) at high temperatures (e.g. above 1100° C.) are required for the reduction of the fine mineral.

The present invention allows for the use of mineral in fine grained form (typically 100% passing a 100 μm aperture screen but 95% coarser than 5 μm diameter). Following agglomeration the agglomerates are capable of being treated in the reduction systems of the present invention. For most naturally occurring titaniferous minerals it will be necessary to grind the feed, using any suitable technique prior to the agglomeration step. Since the titania product derived from a mineral feed which is finer than 20 μm in diameter is not be easily separable from fine iron oxide products in subsequent processing steps the grinding step should seek to minimise the proportion of the mineral reporting to the minus 20 μm fraction. The weight average particle size of the ground product would ideally lie between 50 μm and 100 μm.

The agglomeration step will typically include the addition of binder to a moistened (e.g. 5–12% moisture) fine mineral feed in a suitable agglomerating device. Either low intensity disk or drum type or high intensity mixing type agglomerators are preferably used, although briquetting or any other suitable technique may be applied. A range of suitable agglomeration techniques has been described in International Patent Application No. PCT/AU89/00314. There are few limitations on agglomerate size, although advantageously only a few percent of the agglomerated product should pass a screen with 50 μm aperture and agglomerates of less than 4 mm particle size will be more readily treated in subsequent steps of the present invention. A narrow particle size distribution is not required.

Where the inclusion of additives with the mineral feed is advantageous these additives may be incorporated in either the agglomeration or grinding steps. Even distribution of additives within the agglomerates is advantageous. Additives may be included in powdered or slurry form or in solution with the moisture input to the agglomeration step. Typically additives may include compounds of magnesium, as disclosed in prior art. Alternatively compounds of manganese may be used to achieve special advantages under some circumstances.

Any suitable organic or inorganic binder may be used in the agglomeration step. In many cases a combination of inorganic binder (e.g. sodium silicate, bentonite and other clay minerals, magnesium salts, lime, soda, etc) and organic binder (e.g. lignosulphonate, PVA, molasses etc.) may be advantageous. Binders which hydrolyse in-situ (e.g. tetraethyl orthosilicate, aluminium sulphate/urea mixtures) have also been shown to be effective. Binder additions in the range 0.5–5.0% on a water free basis have been found to be suitable. In the case of inorganic binders it is beneficial to limit binder addition to less than 1% on a water free basis.

In some situations it will be beneficial to operate two separate grinding/agglomeration circuits. Where two mineral sources of different composition and requiring different additive regimens are to be treated separate agglomeration steps can be used. In this manner additives may be incorporated in locations where maximum effectiveness can be obtained, resulting in higher quality products and lower additive consumption.

It is particularly desirable to form agglomerates having an open structure and little closed porosity. In this manner the surface which is available for reduction and for inward diffusion of additives will only be slightly lower than that of the mineral prior to agglomeration. The formation of densely packed agglomerates which shrink and sinter significantly upon heating is consequently to be avoided. The desired open structure is more readily achievable where the mineral to be agglomerated contains only small quantities of material of smaller particle diameter than 20 μm and where the average size of agglomerates is less than 1 mm (although larger particle size can be used).

Additional steps may be incorporated between grinding and agglomeration, for example where grinding has resulted in the liberation of gangue or impurity bearing grains. A separation step of any type but especially including separations based on particle size and density, magnetic or electrostatic response or on surface properties, or on any combination of these properties, may be included. If necessary the liberated and upgraded mineral may then be dried prior to agglomeration, using any suitable drying device.

While reduction may be carried out in any suitable device, e.g. packed bed, fluidised bed or circulating fluidised bed reactors, the most suitable device for continuous, long residence time (greater than 30 minutes), high temperature reduction with metallisation is an inclined rotary kiln, using coal or coke as fuel and reductant. Rotary kilns for iron ore reduction and ilmenite metallisation in the production of synthetic rutile have been in operation for almost two decades and their operation is well documented. Kiln operation according to the present invention is similar to that for synthetic rutile production.

It has been discovered that operation of the process of the present invention is possible at high temperatures without any evidence of accretion formation. This is particularly so in the case of agglomerates because of the ability of agglomerates to absorb any liquid phase (e.g. liquid iron, silicates or oxides) formed in high temperature reduction or local oxidation. Such liquids are held within meniscii formed between solid surfaces within the open agglomerate structure. Consequently the liquid phase cannot act as a bridge between individual agglomerates, and accretion formation is minimised, if not eliminated.

It has not been necessary according to the details of the present disclosure to operate a reduction step at a maximum temperature in excess of 1200° C. in order to produce an acid soluble titania matrix of suitable properties from most titaniferous minerals. For many materials temperatures as low as 1130° C. can be used. Despite the use of highly reducing conditions, nitride and carbide formation are minimal for such relatively low maximum temperatures in reduction.

It has been found that many carbonaceous reductants from lignite to sub-bituminous coals to coke breeze and coke fines can act as suitable reductants according to the present invention. While gaseous reductants may be used in fixed and fluidised bed processes it is most advantageous to use carbothermic reduction in a rotary kiln. Where less reactive carbon sources (e.g. cokes) are used, higher carbon to mineral ratios will apply. More reactive carbon sources such as lignite and lignite char allow the formation of the acid soluble titania phase at lower temperatures.

Where reduction is conducted in a rotary kiln it is found to be advantageous, although not necessary, to operate a kiln temperature profile which is slightly different from that used for synthetic rutile production or the production of direct reduced iron. By adjustment of kiln discharge end burner and kiln freeboard gas combustion air injection locations it is possible to maintain a relatively constant temperature in the reducing zone of the kiln bed for completion of iron metallisation. Titania reduction may then be completed in a short region of rising bed temperature near the kiln discharge end. The result is reaction completion under the necessary high temperature conditions (e.g. at 1170° C.) while the charge is held at significantly lower temperatures (e.g. 1130° C.) for the majority of its reduction time. Such operation also assists in minimising accretions.

For many mineral sources, specifically those containing sufficient magnesium and manganese within the original titania mineral, there is no need to incorporate additives into the agglomerated mineral in order to form an acid soluble titania during reduction. The ability to form a suitable product without additives is a direct advantage provided by agglomeration in enhancing the reduction step and reducing the tendency for accretion formation.

Some guidelines for the need for addition of additives have been established. In particular the titania content of the reduced titania matrix should be accounted for predominantly within a single phase of general chemical formula $M_3O_5$ consisting of a solid solution of $Ti_3O_5$, $MgTi_2O_5$, $Al_2TiO_5$, $FeTi_2O_5$ and $MnTi_2O_5$. It is important for the formation of a high grade acid soluble titania product, that sufficient diluent elements (especially magnesium and manganese) are present to suppress reactions of the type:

$$6\ Ti_3O_5 + FeTi_2O_5 = 5\ Ti_4O_7 + Fe$$

$$8\ Ti_3O_5 + 3\ FeTi_2O_5 = 5\ Ti_6O_{11} + 3Fe$$

which form acid insoluble "reduced rutiles".

As a general rule adequate additive additions will be represented by the following relationship between oxide contents in the final titania product:

$$\frac{1.98\,a + 1.14\,b}{d} \geqq 0.080$$

Where a, b and d have the meanings herein before defined.

While lower levels of additive than suggested by the above expression can be used, operational difficulties can be avoided if the indicated limiting oxide contents are observed. For many ilmenites the above relationship would not recommend the addition of additives at all.

Additives may also be incorporated in order to assist in removal of impurity grains in operations subsequent to reduction. In particular it has been found that chromite metallisation is encouraged by addition of manganese into agglomerates, enhancing chromium removal from the acid soluble titania product by magnetic separation after aqueous aeration in which the magnetic ferrochrome alloy remains passive. Separations based on chromite metallisation are the subject of International Patent Application No. PCT/AU89/00461.

After reduction reduced mineral and excess char are cooled preferably in a rotary drum cooler or any other suitable device. The char may be separated from the minerals by a combination of sizing and magnetic separation. Where the mineral has been agglomerated prior to reduction the reduced agglomerates may be crushed to liberate gangue which has not been metallised, allowing upgrading by magnetic separation.

An important aspect of the present invention is an improvement to prior art processes for removal of metallic iron from reduced mineral. Prior art methods of aqueous aeration for metallic iron removal have been applied to removal of iron only from non acid soluble titania matrices. It has been found that the prior art methods are not always effective in the removal of metallic iron from acid soluble matrices without in-situ precipitation of contaminating iron oxides within titania grains. Difficulties are especially observed where the desired iron oxide product for subsequent separation purposes is a granular magnetite.

The reason that prior art methods of aqueous aeration as practised may not be effective for removal of iron from acid soluble,matrices is associated with both the higher sintering rate of the acid soluble phase in reduction and the different distribution of metallic iron within the titania matrix. The net effect of the differences is that iron metal is less accessible for removal, encouraging iron oxidation and precipitation within titania grains.

The improvement resides in the definition of the necessary conditions for the effective removal of iron metal from an acid soluble titania matrix with control of the nature of the separable iron oxide product. In particular it is the definition of specific reagents which are effective in assisting iron removal by aqueous aeration which is the basis of the improvement.

The method of aqueous aeration presently disclosed involves the agitated suspension of metallised acid soluble titania in a solution of reagents formulated in a particular manner into which finely divided air bubbles are introduced. Advantageously such aqueous aeration is conducted in the temperature range 60°-80° C. and will continue for from 8 to 24 hours.

The improvement comprises adding reagents to the aeration step which form complexes with iron in order to stabilise iron in aqueous solution and also have the effect of locally buffering pH in such a manner that iron oxides form only at higher oxidation potentials, i.e. at sites away from metal bearing grains. The reagents should also ideally act to stabilise a particular iron oxide (e.g. magnetite, haematite, lepidocrocite or goethite). Further, despite prior art references to the use of alkali salts it has been found that such additions are to be avoided, as they interact with the iron oxide product in such a manner as to encourage in-situ iron oxide formation.

Specifically, it has been established that aqueous systems which provide for chelation or complexing of iron i.e. sequestering agents for iron, and therefore have the effect of stabilising iron temporarily in aqueous solution in pores in and around the titanate grains are highly effective as aeration systems. However, the stability of iron in solution must not be such as to prevent its precipitation as iron oxide under the strongly oxidising conditions which exist in the general aeration liquor. Strong stabilisation of iron in solution will result in consumption of complexing reagents and sharp increase in pH. As a consequence further transport of iron out of titanate grains will be retarded and in-situ iron oxide precipitation may result. Both the nature of additives to the aeration step and the level of addition are therefore of importance in ensuring effective aeration. In particular the range of useful additive levels will depend on the nature of the reduced titania product, which in turn depends on its reduction history (i.e. rate of reduction and time held at temperature).

In particular citric acid is a particularly preferred additive for assisting aeration of reduced titania minerals, especially where the titania matrix is acid soluble. Useful additions have been made in the range 0.06 to 1.0% by weight to aerating solutions. Citric acid may be added by itself or in adjunct to other previously disclosed aeration chemicals, such as ammonium chloride. Further, the addition of chloride irons by way of ferric chloride even at high levels (e.g. 5% ferric chloride addition) has been found to be effective. Many other complexing systems are similarly expected to be effective in a manner not previously foreseen.

It has also been discovered that suitably formed reduced agglomerates can be made to disintegrate into subgrains which are roughly equivalent to the original titaniferous grains. This behaviour is associated with the tendency for metallic iron to form bonds between original grains in reduction of agglomerates formed in the manner disclosed. Removal of this intergranular bonding iron then results in disintegration of the agglomerates.

Agglomerate disintegration during aeration allows removal of the thus liberated gangue or impurity bearing grains by any suitable means after aeration. Iron oxides are first removed from the predominantly titaniferous granular product of aeration by wet cycloning, gravity based separation, wet screening or any other effective means. Subsequent separation of non titaniferous grains (e.g. by flotation, magnetic separation, electrostatic separation or gravity based separation) may be used for final product upgrading. Such an upgrading step is particularly useful for impurity grains whose properties are similar to the process feed properties prior to the disclosed treatments but where a property difference exists between product grains (e.g. where the feed is contaminated by chromite).

A particular feature of the acid soluble titania product formed according to the disclosed procedures is that a small amount of metallic iron, at 0.1-2% by weight of the product, remains in a form which is totally inaccessible to aeration or acid leaching. It has been found that this residual iron metal typically is distributed in metal particles of diameter less than 3 μm which are totally encapsulated by dense acid soluble titania. This residual iron metal allows an effective magnetic separation of the product from non magnetic contaminants, e.g. quartz and silicate gangue, while not interfering with the removal of highly magnetic material at lower magnetic field strengths and field strength gradients.

As an optional final step in the disclosed process, titaniferous product washing with dilute acid, for example 5-20% sulphuric acid, may have the effect of slightly increasing product grade by the removal of residual iron oxides (and small quantities of metallic iron).

It has also been established that operation of the processes herein described for the formation of acid soluble titania has the advantage of removing phosphorus impurities, whether present as granular phosphates (removed in the separation steps) or as phosphorus in original titanate grains (removed by reduction into metallic iron and separation with iron oxides during aeration or with leach liquors after leaching).

A further valuable discovery is that chromite grains remaining in the titaniferous products of the processes described herein may not be apprecially soluble in acid digestion of the contained titania. The chromite grains are rendered inert to acid digestion during thermal reduction in the presence of ilmenite. This disclosure has important implications for the usefulness of the product in tile sulphate process for pigment manufacture.

EXAMPLES

The following examples describe a number of tests which serve to illustrate the methods disclosed herein.

EXAMPLE 1

In this example 300 g of a fine grained ilmenite of composition provided in Table 1 and average particle size of 55 μm was mixed with 150 g of Victorian brown coal char (−4 mm +0.5 mm) and placed into a stainless steel furnace pot. A 10 mm layer of char was placed on top of this mixture and the pot was positioned in a heated muffle furnace. The charge reached a maximum temperature of 1180° C. after 75 minutes and was held in the furnace for a further 120 minutes before the pot was removed and allowed to cool in air.

Coarse char was separated from the reduced product by sizing through a 200 μm screen, followed by magnetic separation to provide a separate metallised ilmenite product. Chemical analysis indicated that metallisation of iron was 94.1% complete. X-Ray diffraction analysis indicated that virtually all contained titania was present as anosovite, with no evidence of rutile, reduced rutiles or nitrides/carbides.

Impurity separation after reduction and char separation was tested by magnetic separation of a subsample using a laboratory Carpco lift type magnetic separation, rejecting non magnetics. In this step 44% of the chromium could be rejected as non-magnetic chromite, accompanied by only 10% of the contained titania.

It was necessary to aerate the reduced product for 16 hours in 1.8 liters of 0.5% $NH_4Cl$ solution at 80° C., with initial addition of 2 ml of 10% $H_2SO_4$ solution and with air addition at 0.5 liters per minute for completion of metallic iron removal. The iron oxides formed in aeration were primarily black magnetite, as confirmed by X-Ray diffraction. After removal of separable iron oxides by screening at 38 μm the aeration product contained a total of 6.3% iron, with 0.3% iron present as metal. The titanium content of the product, expressed in terms of the dioxide was 84.4%.

Magnetic separation in a Carpco lift-type magnetic separator was performed to reject 72% of the contained chromium (as chromite), 37% of the contained aluminia and 48% of contained silica to a magnetic fraction, leaving an 86.9% $TiO_2$ non-magnetic product at 0.30% $Cr_2O_3$.

Product acid solubility was tested in refluxing 71% sulphuric acid for 15 minutes. The inseparated aeration product was 88.5% soluble, equivalent to 91.6% titania solubility.

EXAMPLE 2

In this example 5 g of a fine grained siliceous leucoxene of composition provided in Table 2 and average particle size of 55 μm was mixed with 7.5 wt% of finely divided magnesite and placed in a molybdenum furnace boat. This mixture was heated and reduced in a tube furnace under a flow of mixed $CO_2/H_2$ gas to provide an equilibrium oxygen fugacity of $10^{-16}$ atm at 1200° C. for 4 hours.

The reduction conditions were chosen as simulating conditions in a direct reduction kiln. At the end of this equilibration the sample was quenched by withdrawal to a water cooled brass furnace end. X-Ray diffraction indicated that titania was present primarily as anosovite after this treatment, with only trace quantities of the reduced rutile $Ti_4O_7$ remaining. The acid solubility of titania in the reduced product, measured in the same manner as for example 1 was 86.2%.

EXAMPLE 3

Example 3 was conducted identically to 1 example 2 with the exception that 7.5% $MnO_2$ addition was made in place of the magnesite addition. The acid solubility of titania in the reduced product was measured as 97.4% in this case. Investigation of the reasons for the high effectiveness of manganese addition in promoting acid solubility by comparison with magnesium addition (example 2) indicated that magnesium was not distributed evenly throughout the product while manganese was homogeneously distributed. Magnesium penetration into titanate grains was assisted by the fine grained nature of the titania but was limited by diffusion into grain interiors via the solid titania matrix. Manganese was capable of faster transport via vapour phase diffusion.

EXAMPLE 4

Ilmenite having the composition provided in Table 3 was ground and sized to the range −106+53 μm. A sample of 400 g of this material was mixed with 7.9 g of finely divided magnesite and 200 g of −44 mm+1.4 mm brown coal char and placed into a stainless steel pot for identical treatment in reduction, separation and aeration to that summarised in example 1, with the exception that no magnetic separations were performed. Black magnetite was formed in aeration, which was slow and incomplete after 24 hours. The aeration product contained in-situ iron oxides, having a total of 9.7% iron, with 6.2% iron present as metal. The titanium content of the product, expressed in terms of the dioxide was 73.9%. Titania solubility according to the test described in example 1 was 90.3%.

EXAMPLE 5

In this example the ilmenite to be reduced (55 μm average particle size) was first agglomerated with addition of 3% lignosulphonate, 0.7% bentonite and 10% moisture in a laboratory Patterson-Kelly agglomerator. The −2 mm+0.25 mm agglomerated product was dried for subsequent reduction. The composition of the agglomerates is provided in Table 4. A 400 g quantity of agglomerates was admixed with 200 g of −4 mm+1.4 mm Victorian brown coal char, with a top layer of char as for example 1. Reduction at 1180° C. as for example 1 then followed.

After reduction and separation of char from the cooled reduced agglomerates they were carefully crushed in closed circuit with a 90 μm aperture screen such as to fall in the particle size range 38 to 90 μm. Magnetic separation was then used to reject 4.9% of the material to a non magnetic fraction containing 29% of the original chromium and producing a magnetic product having 0.44% $Cr_2O_3$.

Aeration of the reduced, separated product was conducted on a 200 g sample of reduced mineral added to 1.8L of 0.8% ammonium chloride, 0.2% citric acid solution at 0.5L/min air addition and 80° C. for 6.5 hours. The iron oxides formed in aeration were red/-brown lepidocrocite. After removal of separable iron oxides by screening at 38 μm the aeration product contained a total of 6.5% iron, with 0.5% iron present as metal. The titanium content of the product, expressed as the dioxide, was 86.1%.

Magnetic separation in a Carpco lift-type magnetic separator was performed to reject 61% of the contained chromium, 31% of the contained alumina, 24% of the contained silica and 37.5% of the contained phosphorous to a magnetic fraction, leaving an 88.9% $TiO_2$ non magnetic product at 0.33% $Cr_2O_3$.

Product acid solubility was tested as per example 1 without further grinding. The titania in the product was determined to be 88.1% soluble. The final phosphorus content was 0.09% $P_2O_5$ compared with an ilmenite feed phosphorus content of 0.46% $P_2O_5$.

EXAMPLE 6

In this example 300 g of a fine grained ilmenite of composition provided in Table 5 and average particle size of 55 μm was mixed with 150 g of Victorian brown coal char (−4 mm+1.4 mm) and placed into a stainless steel furnace pot for reduction in an identical manner to that described in Example 1.

Magnetic separation of the mineral after reduction removed 25.0% of the contained chromium as non magnetic chromite grains. The reduced and separated product was subjected to aqueous aeration in 1.8 liters of 0.2% $NH_4Cl$, 0.06% citric acid solution for 6.5 hours at 80° C. The iron oxides formed were separated by screening to undersize at 38 μm screen aperture, and were confirmed to consist of red/brown lepidocrocite. The +38 μm mineral contained a total of 4.2% iron, with 0.03% iron present as metal. The titanium content of the product, expressed as the dioxide, was 88.8%.

Magnetic separation was performed on the +38 μm aerator product to reject 29.8% of the contained chromium (as chromite), 13.9% of the contained alumina and 9.9% of the contained silica to a magnetic fraction, leaving a 90.2% $TiO_2$ non-magnetic product at 0.61% $Cr_2O_3$. The final phosphorus content was 0.19% $P_2O_5$ compared with a feed phosphorus content of 0.46% $P_2O_5$.

EXAMPLE 7

Identical treatments were performed on the ilmenite of Table 5 to those outlined in example 6 with the exception that aqueous aeration was performed in 1.8 liters of 1.0% $NH_4Cl$, 0.7% citric acid and 0.3% triammonium citrate. After 24 hours of aeration samples of aerator solids still evolved hydrogen when exposed to 5% aqueous hydrochloric acid, i.e. iron metal removal was not complete. Further, the iron oxide produced in aeration was predominantly a brown amorphous material which did not settle readily and could not be removed from the +38 μm product. It was evident that in-situ iron oxide formation within titanate grains had occurred as the +38 μm product contained a total of 6.3% iron, with continuing evidence of iron present as metal. The titanium content of the product, expressed as the dioxide, was only 82.0%.

EXAMPLE 8

In this example-agglomerates in the particle size range −4 mm+0.25 mm were formed from ilmenite of composition given in Table 6 by mixing with 3% lignosulphonate, 0.7% bentonite and 7% moisture, followed by drying in a rotary dryer. These agglomerates were fed to a 5 m long, 0.4 m internal diameter rotary kiln at 5 kg/hr with 13 kg/hr of −5 mm+0.5 mm Victorian brown coal char. The temperature distribution in the kiln was controlled by use of discharge end burner and air injection lances inserted into the kiln gas space from the feed end such that for the final 2.5 m of kiln length the temperature was above 1100° C. and for the final 0.5 m of kiln length the temperature was 1135° C.

The kiln discharge was cooled in an Archimedes spiral before collection. The cooled discharge was magnetically separated from char and analysed by X-Ray diffraction for the presence of insoluble rutile and reduced rutile. Conversion to anosovite was complete. After removal of metallic iron by leaching with 5% sulphuric acid the mineral product was found to be 85% soluble according to the previously described test equivalent to 90.3% titania solubility by this method.

Analysis of the residues of acid solubility testing of acid soluble titania products prepared in the manner of examples 5 and 6 indicated that only the chromium present within titania grains, amounting to less than 0.20% $Cr_2O_3$ was soluble in the test performed with 71% sulphuric acid. Chromium contained in chromite grains was invariably found to be insoluble, both in tests performed with 71% sulphuric acid and with 92% sulphuric acid. In comparable tests with 92% sulphuric acid on the feed ilmenite 22% of the chromium contained in chromite was dissolved. Chromium present as chromite grains had thus been rendered inert to solution in sulphuric acid by the high temperature reduction process. Grain analyses using electron microscope techniques indicated substantial replacement of iron in the chromite by manganese originally present in the ilmenite. Substantial alteration of the chromite had effectively rendered it inert to acid digestion.

Of the above examples the advantages of commencing with a fine grained mineral, possibly agglomerated, for incorporation of additives and homogeneity of reduction, allowing formation of acid soluble titania from titaniferous feedstocks at relatively low reduction temperatures, as not exemplified in prior art, are indicated by examples 2, 3, 4 and 8. The relative inadequacy of prior art aeration practice (using ammonium chloride additives) in the formation of acid soluble titania is exemplified by comparison of the effectiveness of aeration in terms of time required for iron removal in examples 1 and 4 with that of examples 5 and 6. The effectiveness of complexants in enhancing aeration is demonstrated by examples 5 and 6, and the existence of limitations on complexant addition are indicated by example 7 in comparison with example 6. Further, the ability to alter the nature of the iron oxide product formed in aeration by use of chemical additives is demonstrated in examples 1, 4, 5, 6 and 7.

Example 3 has identified manganese additions as effective in promoting the formation of acid soluble phases in a similar or superior manner to that of magnesium disclosed in the prior art. The effectiveness of separations before and after aeration form removal of chromium and phosphorus is exemplified by examples 5 and 6. The ability to practically produce an acid soluble titania product at relatively low reduction temperatures in a rotary kiln without excessive accretion formation according to the principles disclosed herein is demonstrated by example 8.

It will be clearly understood that the invention in its general aspects is not limited to the specific details referred to hereinabove.

TABLE 1

| Composition of Ilmenite in Example 1. | |
|---|---|
| | wt % |
| $TiO_2$ | 52.0 |
| Fe (total) | 31.45 |
| MgO | 1.55 |
| MnO | 1.53 |
| $Al_2O_3$ | 0.60 |
| $SiO_2$ | 0.98 |
| $Cr_2O_3$ | 0.44 |

TABLE 2

| Composition of Siliceous Leucoxene in Example 2. | |
|---|---|
| | wt % |
| $TiO_2$ | 82.1 |
| Fe (total) | 1.42 |
| $Al_2O_3$ | 1.45 |
| $SiO_2$ | 10.2 |
| $ZrO_2$ | 2.58 |

NB. Sample contains 3.5% free quartz and 3.5% free zircon.

TABLE 3

| Composition of Ilmenite in Example 4. | |
|---|---|
| | wt % |
| $TiO_2$ | 47.3 |
| Fe (total) | 32.3 |
| MgO | 0.21 |
| MnO | 1.64 |
| CaO | 0.87 |
| $Al_2O_3$ | 2.01 |
| $SiO_2$ | 2.09 |
| $Cr_2O_3$ | 0.01 |

TABLE 4

| Composition of Ilmenite Agglomerates in Example 5. | |
|---|---|
| | wt % |
| $TiO_2$ | 50.3 |
| Fe (total) | 28.5 |
| MgO | 1.46 |
| MnO | 1.38 |
| $Al_2O_3$ | 0.91 |
| $SiO_2$ | 0.54 |
| $Cr_2O_3$ | 0.46 |

TABLE 5

| Composition of Ilmenite in Example 6. | |
|---|---|
| | wt % |
| $TiO_2$ | 53.5 |
| Fe (total) | 30.4 |
| MgO | 1.58 |
| Mno | 1.60 |
| $Al_2O_3$ | 0.73 |
| $SiO_2$ | 0.96 |
| $Cr_2O_3$ | 0.65 |
| $P_2O_5$ | 0.46 |

TABLE 6

| Composition of Ilmenite in Example 8. | |
|---|---|
| | wt % |
| $TiO_2$ | 53.4 |

TABLE 6-continued

| Composition of Ilmenite in Example 8. | |
|---|---|
| | wt % |
| Fe (total) | 25.2 |
| MgO | 1.48 |
| MnO | 1.23 |
| $Al_2O_3$ | 1.94 |
| $SiO_2$ | 1.60 |
| $Cr_2O_3$ | 0.62 |
| $P_2O_5$ | 0.46 |

TABLE 7

| SUMMARY OF CONDITIONS FOR THE FORMATION OF A SOLUBLE TITANIA | |
|---|---|
| AGGLOMERATION/REDUCTION | |
| Feed % $TiO_2$ | 45–95 |
| Ground Mineral size range | −250 + 50 μm |
| Agglomerate size range | −4 mm + 100 μm |
| Typical binders | 0.5–1.0% bentonite<br>0–3.0% lignosulphonate<br>0–1.0% poly vinyl actate |
| Agglomeration | 8–12% |
| Maximum reduction temperature | 1130–1200° C. |
| Residence time above 1100° C. | >0.5 hrs |
| Magnesite addition | 0–10% |
| $MnO_2$ addition | 0–10% |
| AERATION | |
| Aeration Chemistry | 0.0–1.0% ammonium chloride<br>0.0–1.0% citric acid<br>0.0–1.0% ammonium thiocyanate<br>0–5% ferric chloride |
| Aeration temperature | 60–80° C. |
| Aeration time | 5–18 hrs |
| Exit gas oxygen content | 1–14% (vol) |

We claim:

1. A process for producing acid soluble titania which process consists essentially of the steps of:

(i) adding a manganese or magnesium compound to a titaniferous mineral if the mineral does not contain sufficient manganese and magnesium to satisfy the following relationship:

$$\frac{1.98\,a + 1.14\,b}{d} \geqq 0.08$$

wherein a represents the percentage by weight of MgO contained in the mineral, b represents the percentage by weight of MnO contained in the mineral, and d represents the percentage by weight of $TiO_2$ contained in the mineral;

(ii) heating the titaniferous mineral in the presence of a reductant at a temperature and for a time sufficient to permit contained iron to be reduced to its metallic form and contained titania to convert to an acid soluble form without significant accretion of the mineral occurring;

(iii) cooling the product of step (ii); and (iv) subjecting the product of step (iii) to an aqueous chemical treatment to substantially remove iron from the mineral wherein the manganese or magnesium compound is an oxide or is capable of decomposing to an oxide under reaction conditions.

2. A process according to claim 1 wherein the manganese compound is added in the form of manganese dioxide.

3. A process according to claim 2 wherein the mineral is agglomerated prior to heating.

4. A process according to claim 2 wherein the step of subjecting the product of step (iii) of claim 1 to an aqueous chemical treatment comprises aerating the product of step (iii) of claim 1 in the presence of a sequestering agent in an amount sufficient to be capable of sequestering iron in aqueous solution and also capable of buffering local pH so that iron oxides form only at sites away from metal bearing grains.

5. A process according to claim 4 wherein the product of step (iv) is washed with dilute acid having a concentration in the range from 5 to 20% by weight.

6. A process according to claim 5 wherein the product of step (iii) is subjected to a magnetic separation with the non-magnetic fraction being extracted as product and the magnetic fraction proceeding to step (iv).

7. A process according to claim 5 wherein step (ii) is performed in an inclined rotary kiln having a discharge end burner and air injection means so located along the rotary kiln that the kiln has a reduction zone and a relatively short completion zone adjacent to its discharge end wherein the reduction zone has a temperature that remains relatively constant and the completion zone has a temperature that increases towards the discharge end of the rotary kiln.

8. A process according to claim 1 wherein the manganese compound is either magnesite or magnesium carbonate.

9. A process according to claim 8 wherein the mineral is agglomerated prior to heating.

10. A process according to claim 8 wherein the step of subjecting the product of step (iii) of claim 1 to an aqueous chemical treatment comprises aerating the product of step (iii) of claim 1 in the presence of a sequestering agent of an amount sufficient to be capable of sequestering iron in aqueous solution and also capable of buffering local pH so that iron oxides form only at sites away from metal bearing grains.

11. A process according to claim 10 wherein the product of step (iv) is washed with dilute acid having a concentration in the range from 5 to 20% by weight.

12. A process according to claim 11 wherein the product of step (iii) is subjected to a magnetic separation with the non-magnetic fraction being extracted as product and the magnetic fraction proceeding to step (iv).

13. A process according to claim 12 wherein step (ii) is performed in an inclined rotary kiln having a discharge end burner and air injection means so located along the rotary kiln that the kiln has a reduction zone and a relatively short completion zone adjacent to its discharge end wherein the reduction zone has a temperature that remains relatively constant and the completion zone has a temperature that increases towards the discharge end of the rotary kiln.

14. A process according to claim 1 wherein the mineral is agglomerated prior to heating.

15. A process according to 14 wherein the mineral is ground prior to agglomeration if it has a particle size in excess of 100 microns.

16. A process according to claim 1 wherein the step of subjecting the product of step (iii) to an aqueous chemical treatment comprises aerating the production of step (iii) in the presence of a sequestering agent in an amount sufficient to be capable of sequestering iron in aqueous solution and also capable of buffering local pH so that iron oxides form only at sites away from metal bearing grains.

17. A process according to claim 16 wherein the aqueous solution contains from 0.06 to 1% by weight of the sequestering agent.

18. A process according to claim 16 wherein the sequestering agent is citric acid.

19. A process according to claim 1 wherein the product of step (iv) is washed with dilute acid having a concentration in the range from 5 to 20% by weight.

20. A process according to claim 19 wherein the acid is sulphuric acid.

21. A process according to claim 1 wherein the reductant is from the group consisting of coal, coke, char, and densified brown coal.

22. A process according to claim 1 wherein the product of step (iii) is subjected to a magnetic separation with the non-magnetic fraction being extracted as product and the magnetic fraction proceeding to step (iv).

23. A process according to claim 22 wherein the product of step (iv) is subjected to a magnetic separation step.

24. A process according to claim 1 wherein step (ii) is performed in an inclined rotary kiln having a discharge end burner and air injection means so located along the rotary kiln that the kiln has a reduction zone and a relatively short completion zone adjacent to its discharge end wherein the reduction zone has a temperature that remains relatively constant and the completion zone has a temperature that increases towards the discharge end of the rotary kiln.

25. A process according to claim 24 wherein the temperature of the reduction zone is about 1130° C. and the temperature in the completion zone reaches about 1170° C.

26. Acid soluble titania produced by a process according to claim 1.

27. Acid soluble titania containing acid insoluble chromite impurities produced by a process according to claim 1.

28. Acid soluble titania containing reduced phosphorus levels where phosphorus is a contaminant in the titaniferous mineral, the acid soluble titania being produced by a process according to claim 1.

29. A process according to claim 1 wherein the temperature to which the mineral is heated lies in the range from 1130° C. to 1200° C.

* * * * *

UNITED STATES PATENT AND TRADEMARK OFFICE

CERTIFICATE OF CORRECTION

PATENT NO. : 5,411,719
DATED : May 2, 1995
INVENTOR(S) : Michael J. Hollitt and Brian A. O'Brien It is certified that error appears in the above-identified patent and that said Letters Patent is hereby corrected as shown below:

Column 2, line 22:

"futile" should be –rutile–.

Column 2, line 64:

After "Becher" delete –)–.

Column 5, line 31:

"(i) should be –iv–.

Column 6, line 20:

After "is not" delete –be–.

Column 9, line 25:

After "soluble" delete –,–.

Column 11, line 13:

"tile" should be –the–.

Column 12, line 18:

Before "example" delete –l–.

Column 15, line 59:

"Mno" should be –MnO–.

UNITED STATES PATENT AND TRADEMARK OFFICE

CERTIFICATE OF CORRECTION

PATENT NO. : 5,411,719
DATED : May 2, 1995
INVENTOR(S) : Michael J. Hollitt and Brian A. O'Brien It is certified that error appears in the above-identified patent and that said Letters Patent is hereby corrected as shown below:

Column 18, line 3, claim 15:

After "according to" insert –claim–.

Column 18, line 25, claim 21:

After "is" insert –selected–.

Signed and Sealed this

Seventeenth Day of October, 1995

Bruce Lehman

*Attest:*

BRUCE LEHMAN

*Attesting Officer*

*Commissioner of Patents and Trademarks*